US012186789B2

(12) United States Patent
Benedetti et al.

(10) Patent No.: US 12,186,789 B2
(45) Date of Patent: Jan. 7, 2025

(54) METHOD AND PLANT FOR PRODUCING FLAT ROLLED PRODUCTS

(71) Applicant: DANIELI & C. OFFICINE MECCANICHE S.P.A., Buttrio (IT)

(72) Inventors: Gianpietro Benedetti, Tricesimo (IT); Paolo Bobig, San Canzian d'Isonzo (IT); Matteo Remy Bulfone, Colloredo di Monte Albano (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 0 days.

(21) Appl. No.: 18/352,070

(22) Filed: Jul. 13, 2023

(65) Prior Publication Data

US 2024/0058853 A1 Feb. 22, 2024

Related U.S. Application Data

(63) Continuation of application No. 17/313,825, filed on May 6, 2021, now abandoned.

(30) Foreign Application Priority Data

Mar. 10, 2021 (IT) ..... 102021000005663

(51) Int. Cl.
*B21B 1/22* (2006.01)
*B21B 13/02* (2006.01)

(52) U.S. Cl.
CPC ..... *B21B 13/02* (2013.01); *B21B 1/22* (2013.01)

(58) Field of Classification Search
CPC ..... B21D 27/02; B21D 27/021; B21D 27/10; B21D 2267/18; B21D 1/24; B21B 1/08; B21B 1/0815; B21B 27/02; B21B 27/021; B21B 27/10; B21B 2267/18; B21B 1/24
See application file for complete search history.

(56) References Cited

U.S. PATENT DOCUMENTS 6,598,448 B1 * 7/2003 Barten ..... B21B 37/32 72/236
2010/0064754 A1 * 3/2010 d'Hone ..... B21B 37/40 72/247

* cited by examiner

*Primary Examiner* — Debra M Sullivan
(74) *Attorney, Agent, or Firm* — Calfee, Halter & Griswold LLP

(57) ABSTRACT

The invention concerns a method and a plant for producing flat rolled products, in order to obtain strips having a multiple crown transverse profile that subsequently have to be divided in a longitudinal direction into strips of a smaller width; the method provides a rolling step carried out in a rolling mill comprising roughing stands and finishing stands equipped with respective work rolls, in order to supply a strip of a determinate width.

12 Claims, 12 Drawing Sheets

(STATE OF ART)
M
S
S1
S2

16a
M
S
F2
F1
25a
25b
24a
24b
L(Tu)
L(T)
L(Bu)
L(B)
P(s)
26

16a
M
S
25a
25b
24a
24b
L(T)
L(B)

16e
F1
S
F2
25a
25b
24a
24b
L(Tu)
L(T)
L(Bu)
L(B)
P(s)
26

16e
S
25a
25b
24a
24b
L(T)
L(B)

10e
F1
F2
S
25a
25b
24a
24b
L(T)
L(Tu)
L(Bu)
L(B)
P(s)
26

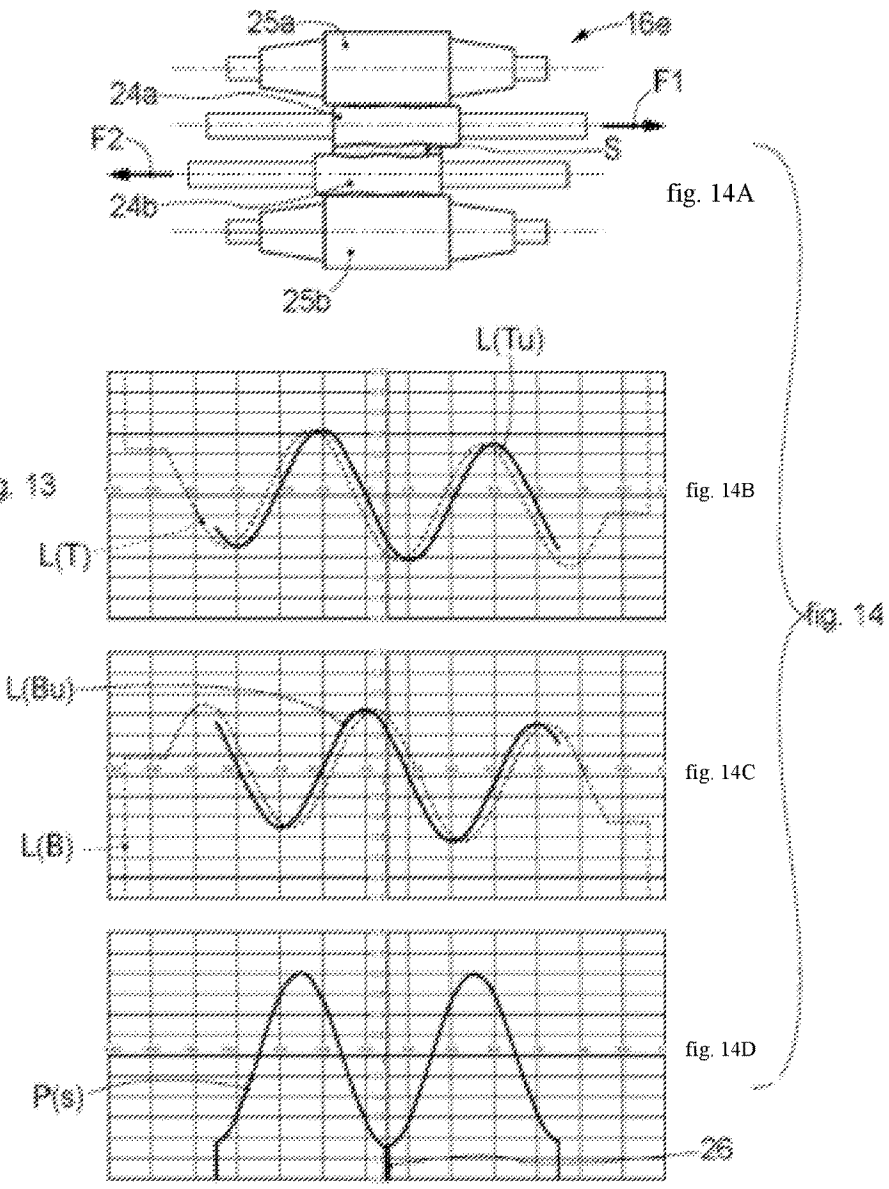
fig. 14
fig. 14A
fig. 14B
fig. 14C
fig. 14D
16a
F1
S
F2
24a
24b
25a
25b
L(Tu)
L(T)
L(Bu)
L(B)
P(s)
26
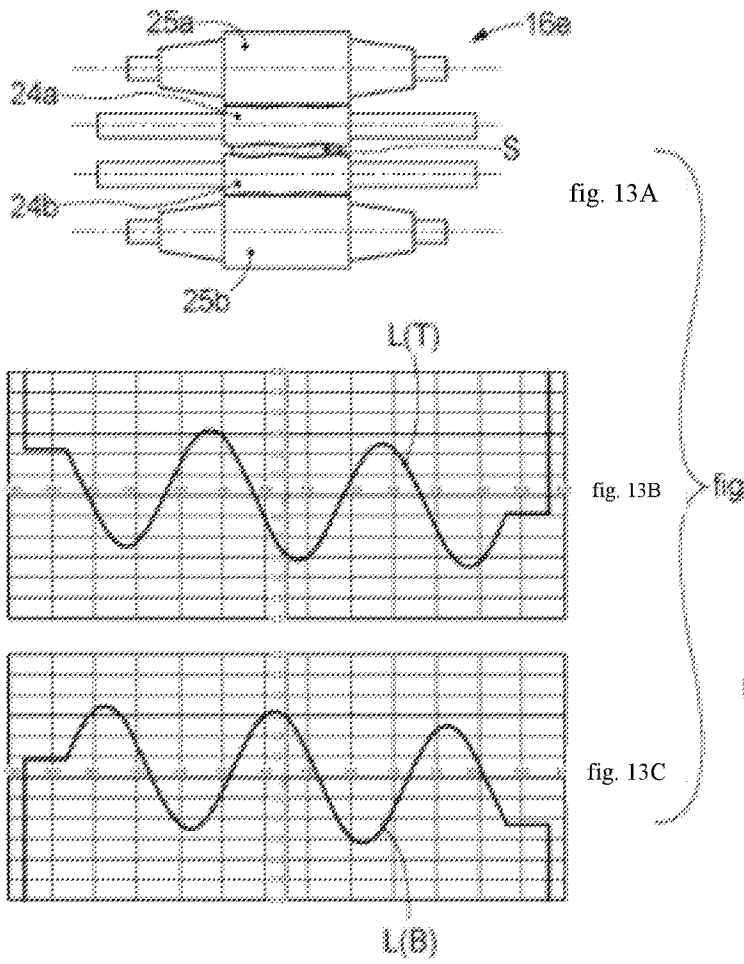
fig. 13
fig. 13A
fig. 13B
fig. 13C
16a
S
24a
24b
25a
25b
L(T)
L(B)

METHOD AND PLANT FOR PRODUCING FLAT ROLLED PRODUCTS

CROSS-REFERENCE TO RELATED APPLICATION

The present disclosure is a continuation application of U.S. patent application Ser. No. 17/313,825, filed on May 6, 2021, which claims priority to Italian Application No. 102021000005663 filed on Mar. 10, 2021, which are incorporated herein by reference in their entireties.

FIELD OF THE INVENTION

The present invention concerns a method for producing flat rolled products, such as strip, and the corresponding production plant. In particular, the invention concerns a method and a plant for obtaining strip having a final transverse profile with multiple crown and with optimal geometric characteristics in terms of profile and planarity of the strip, even in the case where the strip is subsequently divided into longitudinal portions.

The present invention can be applied in rolling processes both hot and cold, for producing strips in any type of ferrous or non-ferrous materials.

BACKGROUND OF THE INVENTION

Rolling plants are known, which comprise a multi-stand rolling mill, normally divided into first roughing stands and second finishing stands. A temperature restoration system may be present between the roughing and finishing stands.

The rolling mill may or may not be disposed in line with a continuous casting machine that produces thin slabs, the so-called "thin slab caster".

These plants can be designed and configured for a substantially continuous rolling process, the so-called "endless" process, in which the cast product is rolled in a rolling mill which is located downstream of the continuous casting machine with which it is directly engaged.

The process can also be the semi-endless type, which provides to cut the cast slab to form a plurality of coils, or the coil-to-coil type which provides to produce one coil at a time for each cut of the slab performed.

It is known that the strip obtained in plants of this type normally has a width that can vary from 600 mm to 2500 mm depending on the intended use of the rolled material.

However, in order to meet market requirements, there is often the need to produce coils with a narrower width than the barrel of the rolling rolls, with a consequent reduction in the productivity of the plant.

For example, if it were desired to obtain a strip width of 800 or 1000 mm on a rolling plant capable of producing strip with a maximum width of up to 2000 mm, casting a slab of width of 800 or 1000 mm, the productivity of the plant would be substantially halved, and this is a disadvantage that should be avoided.

It is therefore known, for example from JPS 58-68405, or from JP 57-175003, to work a strip of standard width, for example 1600 mm, and then cut it in a longitudinal direction, in an inter-stand space along the rolling mill, to obtain two half-strips, for example 800 mm wide, which are then wound onto respective coils.

This solution, although effective in terms of maintaining productivity, has some disadvantages. The first disadvantage concerns the crown of the two half-strips.

The dimensional quality of the product exiting from the hot rolling process has as its focal point the control of the distribution of thickness along the width of the rolled strip. The geometry of the thickness along the width of the rolled product is called profile. The main parameter that is analyzed to evaluate the profile of the rolled product is the crown. The crown represents the difference between the thickness in the center and the average thickness at the edges of a rolled product.

It is generally preferred to obtain a rolled product that is thicker in the center than at the edges; therefore, seen in section, it assumes a lenticular shape symmetrical with respect to the center line, as shown in FIG. 2A.

It is very important to create an accurate profile during hot rolling since this profile cannot be modified in downstream processes, since any possible modifications would cause defects in planarity, as well as difficulties in carrying out the subsequent steps of the production cycle.

On the contrary, the planarity of a rolled product is defined as its ability to adhere to a theoretical plane, and consequently non-planarity is the difference between the theoretical plane and the rolled product.

During rolling a determinate crown is imparted to the strip over the entire width by the rolling rolls, but if a strip thus conformed is subsequently divided in half, each half-strip no longer has a symmetrical crown, as can be seen in FIG. 2B: in fact the profile of the half-strips has a trapezoidal shape (wedge-shaped) with a different thickness at the edges on both sides.

This asymmetrical profile, however, is not very suitable for subsequent processing said half-strips, making their downstream treatment unstable, with possible drift and difficulties in winding. Therefore, to have two finished half-strips, each with its own regular profile, JP'405 provides to carry out another rolling step in another stand in order to recover the symmetry of the profile by tapering the cut edges.

Furthermore, in JP'405 it is problematic to carry out the longitudinal cut in an inter-stand space, and even more problematic to control the two half-strips, especially when dealing with thin thicknesses, due to the high speeds involved.

The solution of JP'405 does not in practice allow to control the crown of the two half-strips since, in the single rolling stand, the profile of the half-strips is returned almost symmetrical simply by Hertzian pressure at the edges.

It can therefore be understood that in the event that the rolled strip must subsequently be divided longitudinally into two half-strips before, or during, or even after winding, in the state of the art solutions are not available for a precise control of the crown.

It should be noted, in this context, that the requirements of the market for flat products, and in particular of hot rolled strip, in recent years have become increasingly stringent, both in terms of metallurgical quality and also in terms of dimensional quality.

Furthermore, plant makers and steel producers are constantly seeking to reduce transformation costs while maintaining, if not improving, the mechanical characteristics and subsequent workability of the hot rolled product.

The following aspects are correlated to the importance of the dimensional quality of the hot rolled strip:

- the progressive replacement, in the production of some products, of cold-rolled strip with hot-rolled strip;
- the simplification of the production process of transforming the hot rolled strip into a finished product;

the improvement of the geometric characteristics in terms of thickness, profile and planarity. In fact, better geometric conditions make the downstream processes more reliable and automatable, as well as improving the quality of the final product.

The above points lead to the requirement for "extreme" geometric characteristics such as for example:

- crown target of the strip which, depending on the type of product, can vary from 70 μm to 10 μm. The crown, for some products (particularly for thin and ultra-thin thicknesses) must be contained within 1.0-1.2% of the nominal thickness of the strip. In other words, a 10 μm crown is required for a strip that is 1.0 mm thick;
- planarity of the strip below 12 and 30 I-Units, depending on the thickness and width of the strip;
- reduction of the drop in thickness at the edges (edge drop) of the strip.

Therefore, in a production process that supplies hot-rolled strip with thin and ultra-thin thicknesses, both in endless or semi-endless and also in coil-to-coil modes, it is necessary that the rolling stands have an adequate capacity for controlling the profile and planarity of the strip for the entire production mix.

It is therefore known to use work rolls having a shaped form, that is, with the contour or profile that is described by a mathematical function so that, by means of an axial shifting of the rolls in the opposite direction, the shape of the rolling gap can be varied.

With regard to the crown, it must also be considered that the heating of the rolling rolls is one of the basic problems to be faced in both hot and cold rolling. The direct contact of the strip being rolled with the work rolls determines a thermal flow, with heat transfer to the rolls themselves, and consequent heating thereof; this entails variations both in the dimensions (diameter) and also in the profile of the rolls themselves.

In order to limit said heating to values compatible with the characteristics of the material that makes up the rolls, and such as to contain the progressive deterioration of the surface of the rolls within acceptable values, it is essential to use cooling systems.

The solution that is generally used in hot rolling is to cool the work rolls from the outside with a series of nozzles installed on some ramps. In a conventional 4-high rolling stand for hot strip mills, four cooling devices are generally used: two in the exit zone and two in the entry zone. Each device consists of one or more cooling ramps. To prevent the heat transmitted from the material being rolled to the roll from penetrating from the surface layers toward the inside of the roll itself, with subsequent consequent difficulty in extracting the heat accumulated inside, it is preferred to increase the heat exchange between the roll and the cooling water in the exit zone from the rolling gap, increasing the flow rates and, possibly, the heat exchange efficiency.

The heat transmitted to the rolls produces a thermal crown; an axial flow occurs since the heat, in the roll, flows from the central zone to the two sides which, not being affected by the contact of the strip, are colder. The result is a differentiated expansion which, generally, produces a roll profile with a quasi-parabolic shape in the central zone, while at the edges of the strip it abruptly decreases and then remains at lower values than those of the central zone.

The variations in the "thermal profile" of the rolls clearly affect the rolling process and, in particular, the control of thickness, profile and planarity; it is therefore the task of the system for cooling the rolls to minimize disturbances due to variations in the thermal profile, without prejudice to the fact that the temperatures of the rolls must on average reach values that vary from 50 to 80° C. (depending on the material that makes up the jacket of the roll) to optimize the duration, reducing surface wear caused by thermal fatigue and friction between the strip and the roll.

These problems, already considerable in the case of hot rolling with conventional processes, are even more exasperated for endless production processes, in which rolling on the strip finishing mill can last up to 10 hours without interruption, compared to 2-3 minutes of the conventional coil-to-coil process.

The thermal crown of the work rolls depends on the temperature distribution along the axis of the roll; this distribution varies continuously, during the rolling campaign, causing both increases and decreases in the thermal crown with variations in the work profile of the roll. This phenomenon creates disturbances on the control of the profile and planarity of the strip being rolled:

- when the rolls are cold, for example after a roll change or after a long production pause, the thermal crown gradually increases; it takes from 5 to 10 coils to reach stable values;
- when stable conditions are reached during the rolling campaign, the thermal crown decreases during the waiting time between one coil and the next, returning to the average value of thermal crown after a relatively short time from the start of the rolling of the new coil.

Given all of the above, one purpose of the invention is to provide a method, and a corresponding plant, for the production of finished thin and even ultra-thin strip, which can subsequently be divided longitudinally in such a way as to obtain 2, 3, 4 or more distinct strip portions, each portion of the strip having optimum quality in terms of profile, planarity and thickness of the cross-section.

The purpose of the invention is also to maintain the productivity of the rolling mill unchanged, whether a strip of width equal to the maximum width is being produced, or when strips of a width smaller than said maximum width are to be produced.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe variants or define embodiments of the main inventive idea.

According to one embodiment of the present invention, a slab is cast at a width defined by the design parameters of the plant itself, such as the width of the mold, the sizing of the line, the productivity required, etc., and sent to a hot strip rolling mill to obtain the final required thickness.

According to another embodiment of the present invention, a hot rolled strip is further rolled in a cold rolling mill in order to obtain thinner thicknesses.

In both of these embodiments the work rolls of the stands of the rolling mill are configured to impart to the strip a transverse profile having a number of crowns correlated to the number of longitudinal portions into which the strip has to be subsequently divided.

Hereafter we will use the following terminology:

- "Positive" crown to indicate a symmetrical lenticular profile, thicker in the center, such as the one shown in FIG. 2A;

"Negative" crown to indicate a bi-concave symmetrical profile, mating with or complementary to the lenticular one, thinner at the center than at the edges.

In accordance with the present invention, the aim is to produce two or more positive crowns on the rolled strip by using work rolls with a shaped profile having two or more corresponding negative crowns.

The invention therefore provides to use work rolls with single crown when the finished strip will be used at the width of the starting product that is fed to the rolling mill, while work rolls with double, triple, quadruple or in any case multiple crown will be used when the rolled strip has to be subsequently divided longitudinally into two, three, four or in general into a certain number of longitudinal portions of strip.

The longitudinal division of the strip can occur along the entire length of the strip, from head to tail, in a position between the exit from the last stand and respective distinct winding units on which the individual coils of the portions of strip are formed, or it can occur along the entire length except for a segment of the head and tail of the strip immediately before the winding onto a single coil, or it can occur after removing the coil from the winding unit, for example in the destination site of the coil itself.

According to the present invention, at least the last stand of the rolling mill, for example the last stand of the finishing mill, or the last two or three stands of the finishing mill, comprise work rolls whose contact surface with the strip has a shaped profile that is correlated and dependent on the portions of the strip that will be subsequently obtained with the longitudinal cut.

In other words, the profile of the work rolls will have a double negative crown if the strip will be divided longitudinally into two half-strips (double crown), it will have a triple negative crown if the strip will be divided longitudinally into three portions of strip (triple crown), and so on.

It is known from literature that the profile of the work roll can be defined by a curve consisting of an anti-symmetric trigonometric function and a $3^{rd}$ order polynomial function.

The equations of the profile's curve are as follows:

$$D_t(y)=D-C\sin\alpha/b(y-\delta_s-\delta_0)+a_1(y-\delta_s-\delta_0)+a_3(y-\delta_s-\delta_0)^3$$

$$D_b(y)D+C\sin\alpha/b(y+\delta_s+\delta_0)+a_1(y+\delta_s+\delta_0)+a_3(y+\delta_s+\delta_0)^3$$

wherein:

Dt(y) is the diameter of the upper work roll;

Db(y) is the diameter of the lower work roll;

D is the nominal diameter of the work roll;

is the angle of the modifiable shape of the curve of the gap between the rolls;

b is the barrel length of the work roll;

C is the amplitude of sine curve;

δ0 is the value of the primary displacement of the shaped curve of the roll;

δs is the value of the relative movement from the primary position;

$a_1$ is a first coefficient;

$a_3$ is a second coefficient.

In particular, the amplitude "C" refers to the width of the single crown.

The value of the crown can also be modified by varying the value δ0 of the axial movement (shifting) of the work rolls and, by varying the parameters α and C of the above formulas, the crown function of the gap between the rolls will determine a group of different curves.

Therefore, according to the present invention, by assigning suitable values to the coefficients α and C of the formulas above, it is possible to obtain the "double crown" profiles, in the event the strip produced is divided into two half-strips, or even triple or quadruple crown, in general multiple crown profiles, in the event the strip is divided longitudinally into several portions.

As mentioned, the operation of imparting to the strip a double (or triple, or quadruple, . . . ) crown is performed in the last stands of the finishing mill, for example in the last or in the last two or three, in the event of particularly thin thicknesses.

It should be noted that in a finishing mill with five or six or seven finishing stands, the last three stands generally have work rolls with the same diameter and the same profile. Therefore, according to the invention it is convenient to make the multiple crown in the last three stands of the finishing mill.

The invention therefore provides to produce a finished strip with multiple crown, which is subsequently divided longitudinally in such a way as to obtain multiple distinct strip portions, each with its own crown as if they were rolled individually.

In this way, each portion of the strip has the correct crown to obtain the desired geometric and dimensional characteristics in terms of thickness, profile and flatness.

According to the invention, for a more accurate control of the multiple crown, in addition to the mechanical crown of the work rolls, an intervention is also carried out on their thermal crown with a cooling method described below.

In the case of double crown rolling, according to the invention it is advantageous to have minimum cooling efficiency around the central zone of the work roll, so that the thermal crown increases in this zone, where the strip will then be divided, and instead have maximum cooling efficiency in correspondence with the central part of the two halves of the strip, so that the thermal crown decreases in the central zone of the half-strip. In other words, the thermal crown of the work roll is controlled so that it follows the trend of the mechanical crown, enhancing it. In the same way, also for the triple, quadruple, etc., crown the cooling of the work rolls is modulated in a similar manner, cooling less where the strip will be divided and cooling more in the central zones of the respective multi-strips.

The control of the cooling system is essentially achieved through an on-line model which, at time intervals, processes a series of information on the status of the process (temperatures of the strip, rolling forces, thickness reductions, rolling speed, etc.) thus determining the thermal profile.

The possibility of modifying the cooling efficiency on the width according to the invention allows to define, along the double or in general multiple crown rolling campaign, the optimal thermal crown, such as to maximize the profile/flatness control capacity on the portions of strip which will then have to be divided.

BRIEF DESCRIPTION OF THE DRAWINGS

We will now describe, in detail, this and other characteristics of the invention, with reference to some of its particular embodiments, given as a non-restrictive example with reference to the attached drawings wherein:

FIGS. 4 to 15 (including FIGS. 4A-4C, FIGS. 5A-5D, FIG. 6, FIGS. 7A-7C, FIGS. 8A-8D, FIG. 9, FIG. 10, FIGS. 11A-11D, FIG. 12, FIGS. 13A-13C, and FIGS. 14A-14D) show graphs representative of the profiles of the work rolls, and of the resulting corresponding profiles of the strip, in the case, respectively, of a double, triple or quadruple crown profile for a strip width of 2000 mm and in the case of a double crown profile for a strip width of 1600 mm;

DESCRIPTION OF SOME PREFERRED EMBODIMENTS OF THE INVENTION

Figure 1:
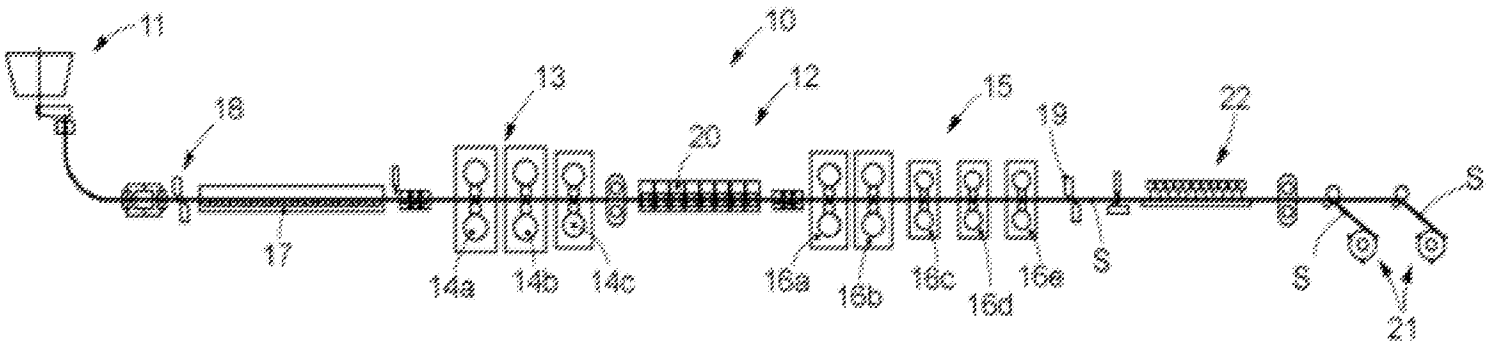
FIG. 1 shows an example of a lay-out of a hot strip rolling plant on which the production method according to the invention is applicable.

With reference to FIG. 1, an example is shown of a co-rolling plant 10 for producing strips S, in which a machine 11 for casting thin slabs feeds a hot strip rolling mill 12.

It should be noted that the example shown is not to be considered in any way as limiting the applicability of the present invention, since the concepts set forth find application in a number of other types of plant, with a different number of stands, with casting separated from the rolling mill, with slabs produced elsewhere and in any case in all situations in which a metal strip, having a determinate nominal width at the end of the rolling, has to be divided longitudinally into several portions in order to obtain strip portions with smaller widths.

While the embodiment disclosed in the figures represents a hot rolling mill provided in line with the casting machine, the present invention can be applied also to cold rolling mills in which a strip obtained by a previous step of the hot process is rolled.

In the case of hot rolling process, as mentioned, the starting semi-finished product is represented by a slab that can be cast in-line on the same plant (as disclosed in the embodiment of FIG. 1) or produced off-line or in another plant.

In the case of a cold rolling process, the starting semi-finished product is represented by a coil of rolled strip previously produced in a hot rolling mill. According to the invention, in the cold rolling, in order that the rolling rolls are able to impart multiple crowns to a previously hot rolled strip having a single-crown, it is preferable that the thickness of the strip is at least 2.5 mm. Below this value, it is preferable that the strip to be cold-rolled does not have a single crown profile, but has already the number of the final crowns to be obtained at the end of the cold rolling. In this case, in the cold process, the rolling rolls are shaped to follow the multicrown profile that has been already imparted to the strip in the previous hot rolling process.

Moreover, the present invention can be applied for the production of both ferrous, such as steel, and non-ferrous, such as aluminum, strips.

In this specific example shown in FIG. 1, the rolling mill 12 comprises a roughing unit 13 (or roughing mill), comprising in this case three stands 14A, 14B and 14C, and a finishing unit 15 (or finishing mill), comprising in this case five stands 16A, 16B, 16C, 16D and 16E.

Between the roughing unit 13 and the finishing unit 15 there is a temperature restoration system, for example an induction furnace 20, which takes the slab at exit from the roughing unit 13 back to the correct rolling temperature.

Between the casting machine 11 and the roughing unit 13 there is a tunnel furnace 17 having a length sufficient to contain at least a number of slabs comprised between 2 and 5. This tunnel furnace 17 allows, in a known manner, both to function as buffer in the event the rolling mill is interrupted, even temporarily, due to accidents or a planned change of the work rolls, and also to operate in semi-endless mode.

Upstream of the tunnel furnace 17 there is a first pendulum shears 18, which cuts the slab to size when the plant 10 operates in coil-to-coil or semi-endless mode.

Downstream of the finishing mill 15 there is a cooling unit 22 and a second flying shears 19, which intervenes in the case of endless or semi-endless rolling to separate the strip gripped on one of the two down-coilers 21, or reels.

In accordance with one aspect of the present invention, the strip obtained is subsequently divided longitudinally (slitting), so as to obtain portions of strip having a width that is a submultiple of, or in any case smaller than, the width of the cast slab.

In this way, it is possible to obtain strips with a smaller width from a single rolled strip without limiting in any way the overall productivity of the plant, which can always work with a width of the slab and of the strip close to the maximum one provided for the plant itself.

The division in width of the final rolled strip can take place directly in line, at exit from the rolling mill, or in a step following the removal of the coil, for example in a different destination plant where the strips are used.

In the first case, the division downstream of the finishing mill 15, for example into two parts, can concern:

- the entire length of the strip S, from head to tail, winding two different half-strips S1, S2 onto respective reels 21: in this way, two distinct coils will be obtained;
- the entire length of the strip S except a portion of the head and of the tail thereof, in order to facilitate the entry of the head into the single reel and the winding of the last tail-end turn: in this way, there will be a single coil sectioned into two parts for almost the totality of its length.

For this purpose, dedicated cutting devices can be provided which longitudinally separate the strip S into two or more strip portions S1, S2 having the same or different width. Advantageously, these devices can be inserted into and extracted from the production line based on requirements.

According to the number of portions in width into which the strip S will be divided, the present invention provides to make the profile of the work rolls 24*a*, 24*b* of at least some of the last finishing stands 16*a*-16*e* so as to determine the correct crown on each of the portions into which the strip will be divided.

Figures 2, 2A, 2B, 3, 3A, 3B:
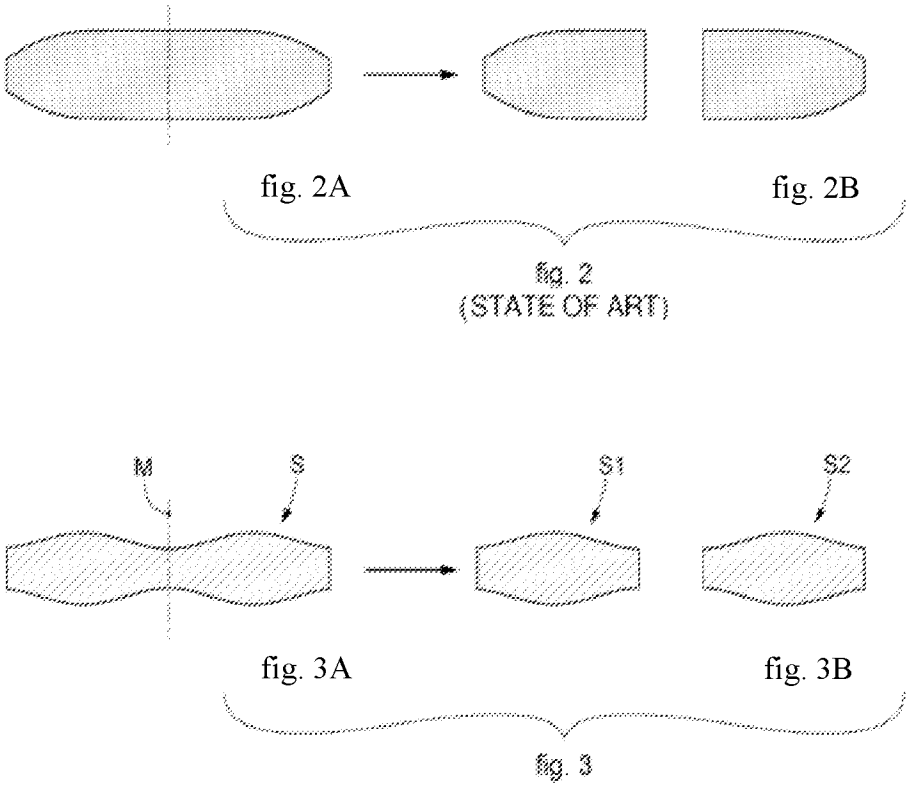
FIG. 2, including
FIGS. 2A and 2B, shows a section of one strip and of two half-strips obtained by means of a longitudinal cut of the strip according to the state of the art.
FIG. 3, including
FIGS. 3A and 3B, shows a section of one strip and of two half-strips obtained by means of a longitudinal cut of the strip according to embodiments of the present invention.

By way of example, FIGS. 3A and 3B respectively show the cross-section of a strip S downstream of the rolling mill 12, and the sections of the two half-strips S1, S2 obtained by longitudinally cutting the strip S along the center line. In the example, the strip S has a "double positive crown" which is substantially symmetrical with respect to a plane of symmetry passing through the center line M, while the two half-strips S1, S2 each have their own single positive crown.

Therefore, in the event the strip is divided in width into two half-strips, the profile of the work rolls 24*a*, 24*b* will show a double negative crown, one for each half-strip obtained or obtainable downstream, the same is the case in the event of three, four or more divided portions of strip.

The profile of each work roll 24*a*, 24*b* can be defined by a curve consisting of an anti-symmetric trigonometric function and a 3rd order polynomial function.

The equations of the profile's curve are as follows:

$$D_t(y)=D-C\sin\alpha/b(y-\delta_s-\delta_0)+a_1(y-\delta_s-\delta_0)+a_3(y-\delta_s-\delta_0)^3$$

$$D_b(y)D+C\sin\alpha/b(y+\delta_s+\delta_0)+a_1(y+\delta_s+\delta_0)+a_3(y+\delta_s+\delta_0)^3$$

wherein

Dt(y) is the diameter of the upper work roll 24*a;*

Db(y) is the diameter of the lower work roll 24*b;*

D is the nominal diameter of the work roll;

is the angle of the modifiable shape of the curve of the gap between the rolls;

b is the barrel length of the work roll;

C is the amplitude of sine curve;

δ0 is the value of the primary displacement of the shaped curve of the roll;

δs is the value of the relative movement from the primary position;

$a_1$ is a first coefficient;

$a_3$ is a second coefficient.

According to the present invention, by assigning suitable values to the coefficients α and C of the formulas above, it is possible to obtain the "double crown" profiles, in the event the strip produced is divided into two half-strips, or even triple or quadruple crown, in general multiple crown profiles, in the event the strip is divided longitudinally into several portions.

Once the profile of the work rolls 24*a*, 24*b* has been determined (mechanical crown), the extent of the crown on the strip can be modified by varying the value δs of the axial movement (shifting) of the work rolls 24*a*, 24*b*, as shown in FIGS. 6, 9, 12, 15.

Figures 4, 4A, 4B, 4C, 5, 5A, 5B, 5C, 5D:
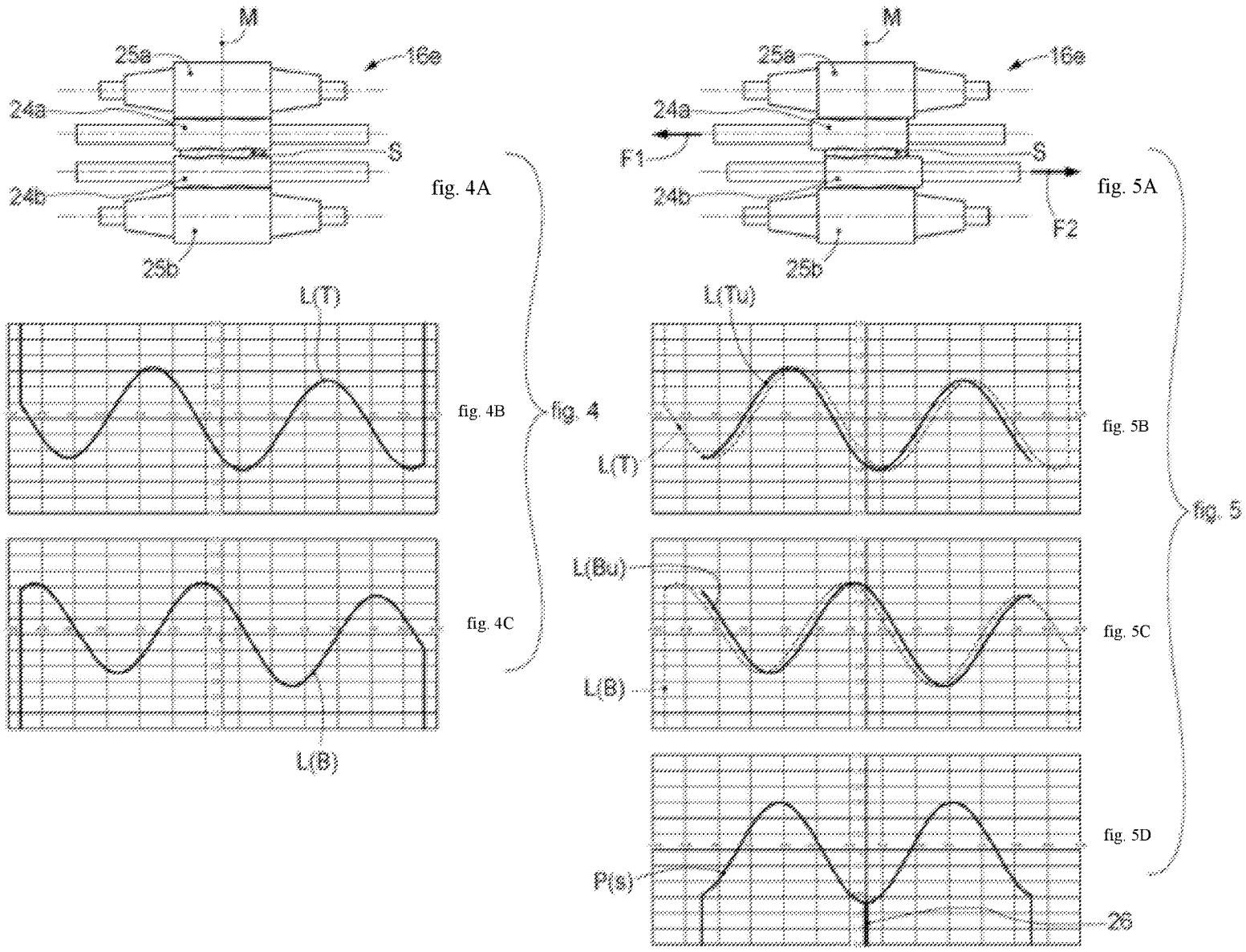
Figure 6:
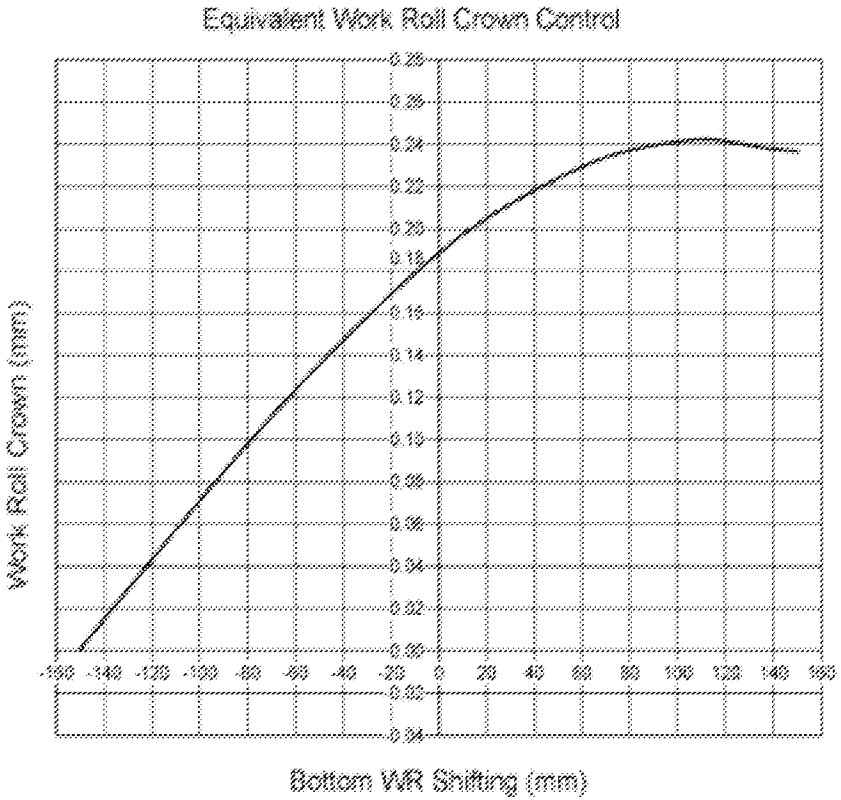

With reference to FIGS. 4-6, an example is shown in which the strip S has a width of 2000 mm, corresponding to the width of the cast slab, and is rolled with a double crown by work rolls 24*a*, 24*b* having a barrel length equal to 2450 mm, in order to be subsequently divided longitudinally into two half-strips of 1000 mm. It should be understood that these drawings represent the case in which the division is into two halves of equal width, as shown for example in FIG. 3B, however we do not exclude that the two portions of strip can have different widths.

As an example, the last finishing stand 16*e* (however, it could be the last two, three or more), is represented in FIGS. 4A and 5A as comprising upper 24*a* and lower 24*b* work rolls, and upper 25*a* and lower 25*b* support rolls.

FIGS. 4B-4C and 5B-5C represent the profile, respectively, of the upper work roll 24*a* and of the lower work roll 24*b*, in two distinct operating conditions.

In FIGS. 4B and 4C the profile of the work rolls 24*a* and 24*b* is represented for the entire length of the barrel by lines L(T) for the upper work roll 24*a* and L(B) for the lower work roll 24*b*, in a non-axially shifted condition.

In FIGS. 5B and 5C the lines L(T) and L(B), indicated with a dashed line, again represent the profile of the entire length of the barrel of the work rolls 24*a*, 24*b*, while the solid lines L(Tu) and L(Bu) represent the useful part of the profile of the work rolls which works on the strip S, in an axially shifted condition, as represented by the arrows F1 and F2 in FIG. 5A.

Finally, FIG. 5D shows the resulting profile P(S) of the strip S as the sum of the profiles L(Tu) and L(Bu). The vertical end lines indicate the lateral edges of the strip S, while the central vertical line 26 indicates the central point in which the strip S will be divided.

As can be seen from the graphs, the profile of the work rolls 24*a*, 24*b*, and obviously the resulting profile of the strip P(S), has a "double crown" shape, with two humps and two corresponding troughs which create the desired crown on the resulting profile of the two half-strips into which, in this specific case, the strip S will be divided.

In particular, the crown on the work rolls 24*a*, 24*b* is "negative", that is, it has a concave shape, while a "positive" crown, that is, having a convex shape, is obtained on the rolled strip S.

In this way, the strip S can be divided longitudinally in correspondence with its centerline, with the possible removal of a small central band in order to make the crown of the two half-strips "perfectly" symmetrical.

It should be considered that the extent of the crown of the single "hump" is a function of the axial shifting of the work rolls 24*a*, 24*b*.

This is an advantage because the adjustment of the profile is not static, but can be of a dynamic type and the extent of the shifting of the work rolls 24*a*, 24*b* will vary in relation to the operating conditions of the work rolls 24*a*, 24*b*.

In addition, a same profile of the work rolls 24*a*, 24*b* can be applied on several stands, making them operate in different shifting fields, in order to maintain the homothety of the section of the strip S in the last rolling stands. This is in order to not penalize the planarity of the strip S itself.

The graph of FIG. 6 shows how the crown of the strip S can be modified by acting on the shifting, that is, the axial displacement of the two work rolls 24*a*, 24*b* in order to vary the surface portions of the respective roll which work directly on the strip S.

Thanks to the axial shifting of the work rolls 24*a* and 24*b* it is possible to accentuate or flatten the ridges and valleys of the profile of the strip S, which means increasing or decreasing the crown of the S strip.

The shifting of the work rolls 24*a* and 24*b* is symmetrical, that is, the rolls are translated in the opposite direction with respect to the center line M by an equal value.

In the graphs of FIGS. 5A-5D, a shifting equal to 50 mm was considered.

Figures 7, 7A, 7B, 7C, 8, 8A, 8B, 8C, 8D:
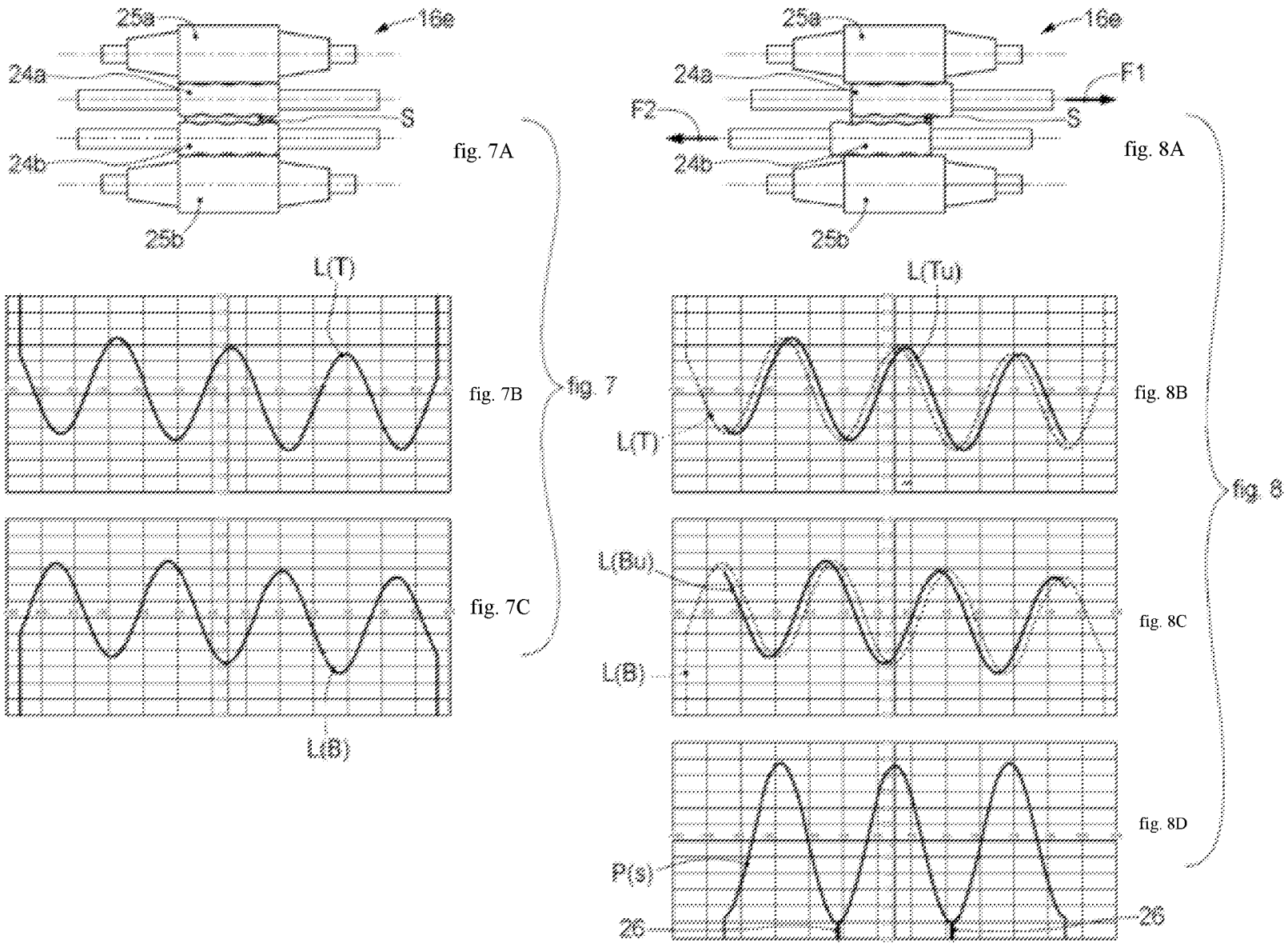

FIGS. 7 and 8 represent the case in which the strip S has to be divided longitudinally into three portions, in this case, each having a width equal to ⅓ of the width of the strip S.

FIGS. 7A and 8A show the upper 24*a* and lower 24*b* work rolls with respective profiles having a triple negative crown.

Also in this case, FIGS. 7B, 7C represent the profile of the entire barrel length of the work rolls 24*a*, 24*b* in a reciprocally non-shifted condition, while FIGS. 8B and 8C represent the useful work portion L(Bu), L(Tu) of the work rolls 24*a* and 24*b* in a condition in which they are reciprocally shifted by 50 mm.

Number 26 in FIG. 8D represents the two sections which allow to obtain the three portions from the strip S produced.

It can be seen how the profile of the work rolls 24*a* and 24*b* is shaped with a negative crown so as to obtain a profile of the strip with a triple hump which, as can be seen in FIG. 8D, determines a resulting profile with triple positive crown, in this case, substantially symmetrical with respect to the center line of each of the (three) portions into which the strip S is divided, in correspondence with the sections 26.

Figure 9:
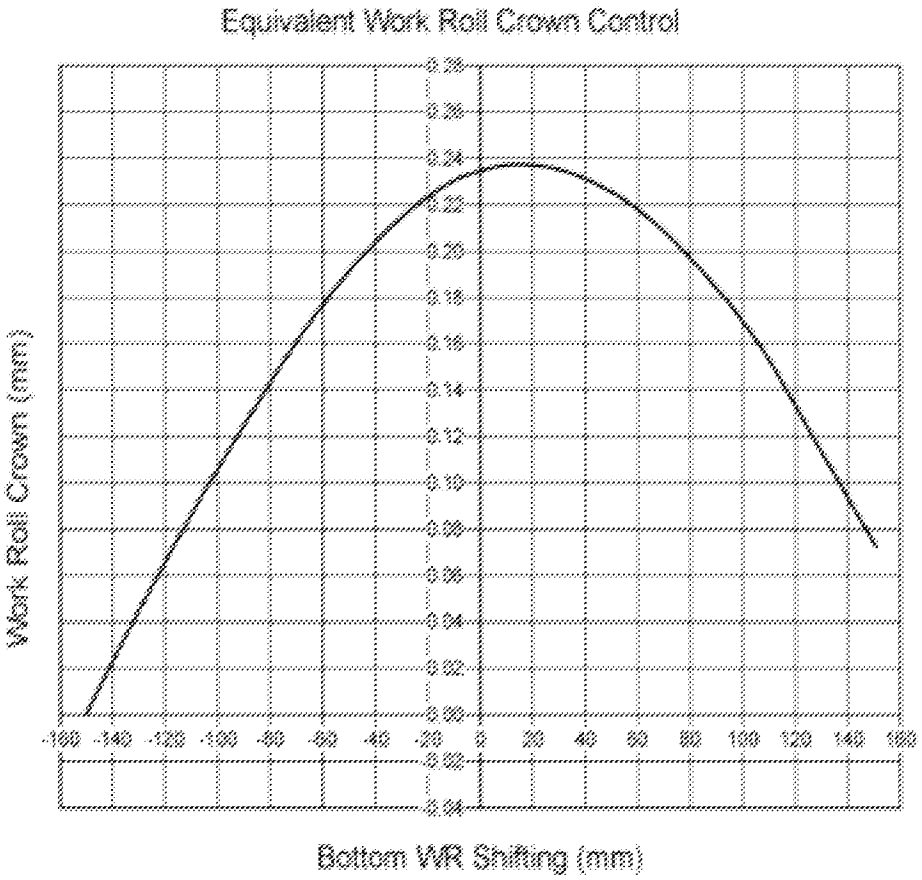

FIG. 9 shows, in a corresponding manner, the range of control of the crown that can be obtained by the axial shifting the work rolls 24*a*, 24*b*, which are shaped as shown in FIGS. 7B and 7C.

Finally, in a manner substantially equivalent to the cases described above, FIGS. 10 and 11 concern the case in which the strip S produced has to be divided into four portions, in this specific case, all with a substantially equal width.

Figures 10, 11, 11A, 11B, 11C, 11D:
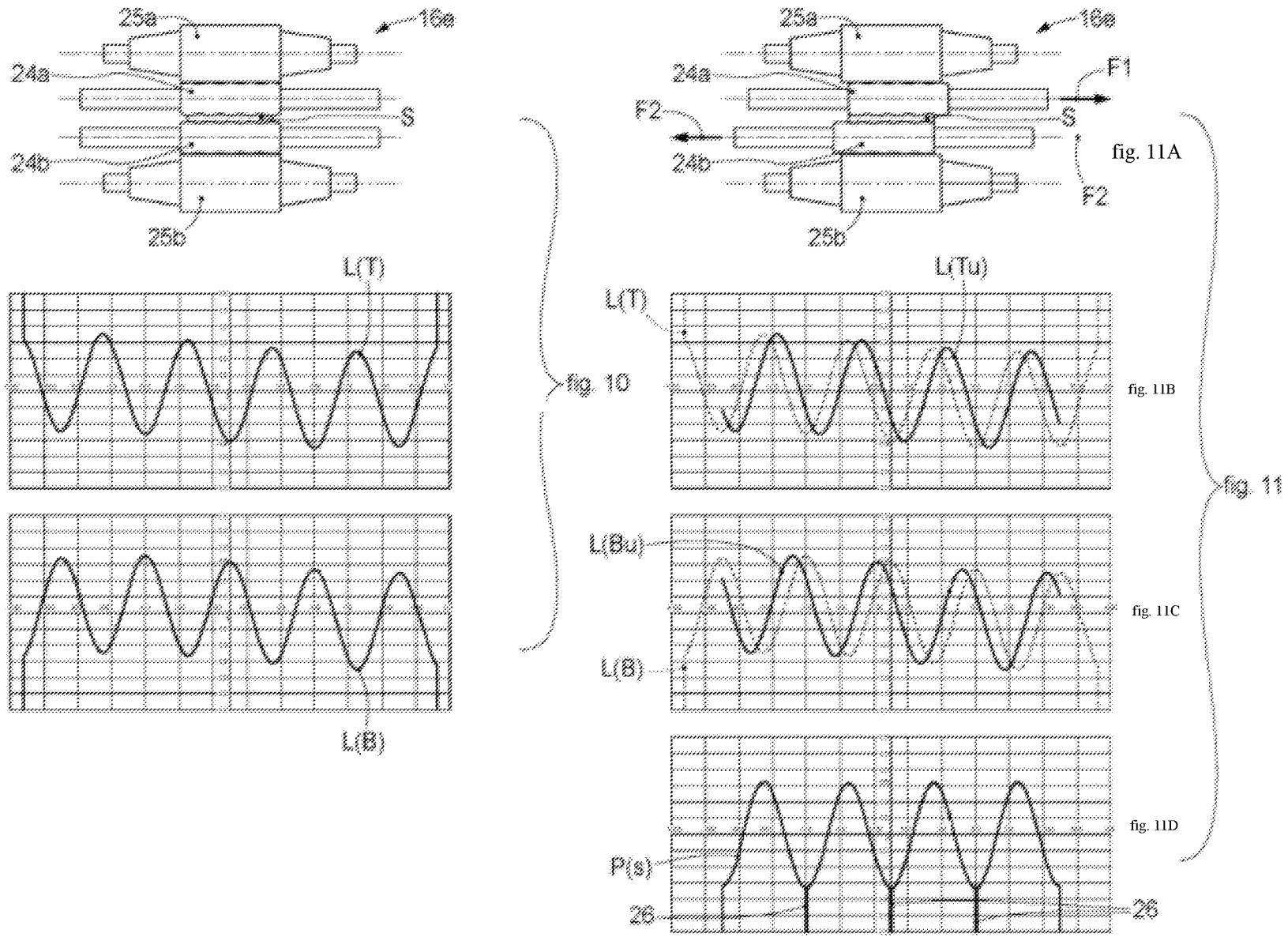

Without repeating the concepts expressed above, we wish to point out how the profile of the work rolls 24*a*, 24*b* is shaped with a quadruple negative crown, and in FIG. 10 it is represented in a non-shifted condition. FIG. 11 represents the shifted condition of the two work rolls 24*a*, 24*b* with the useful profile L(Tu), L(Bu) respectively of the upper 24*a* (FIG. 11B) and lower 24*b* (FIG. 11C) work rolls shown with a solid line. In this case, the two work rolls 24*a*, 24*b* are shifted by 80 mm.

The resulting profile of the strip S (FIG. 11D) has the four humps or positive crowns in a substantially symmetrical position, so that, after the longitudinal separation of the four portions by means of the sections 26, each portion has the correct pre-established crown.

Figure 12:
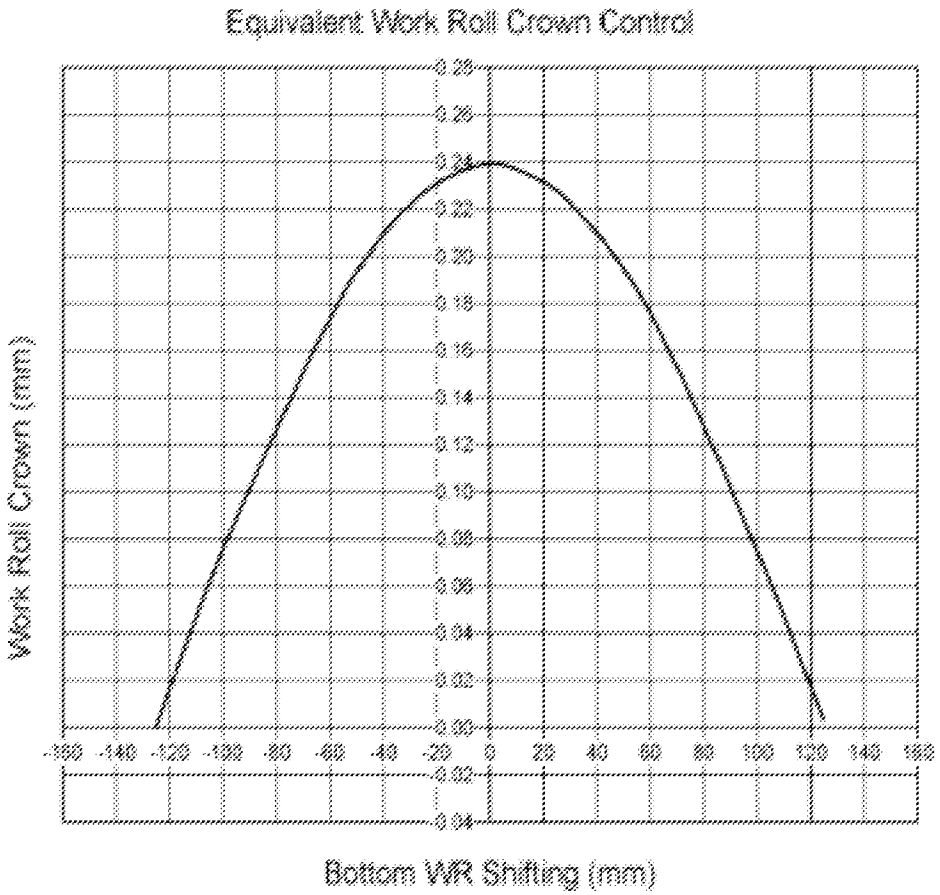

As in the previous cases, using the axial shifting allows to achieve control of the crown, as shown for example in FIG. 12.

Figure 15:
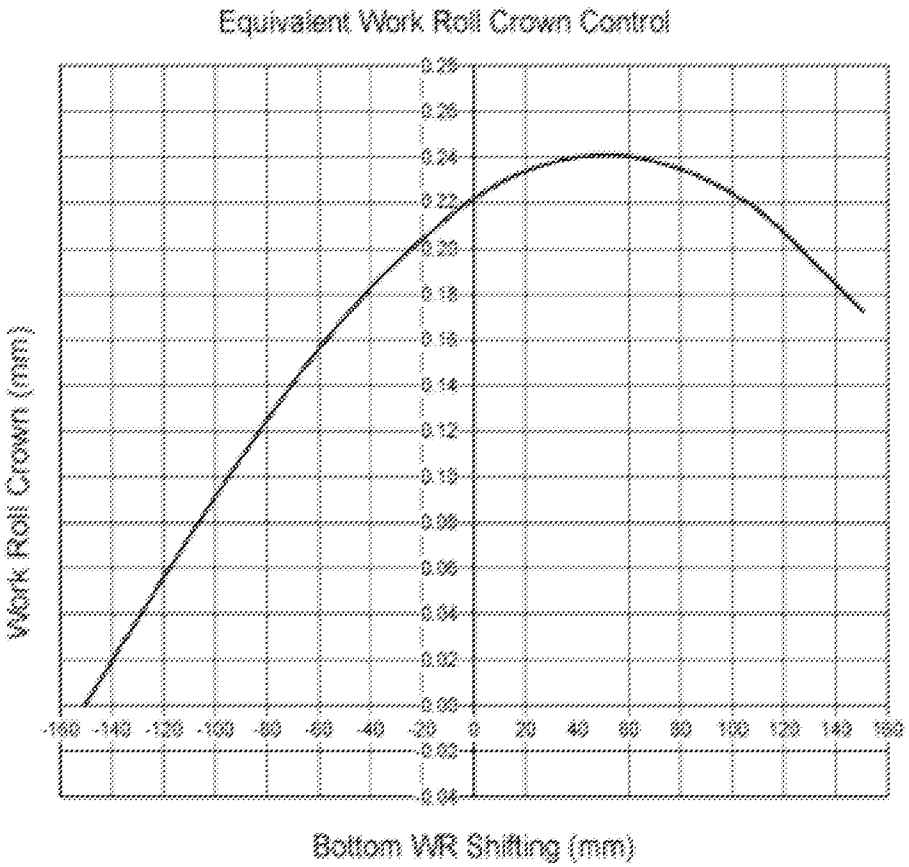

With reference to FIGS. 13-15, an example is shown in which a strip S is produced, on the same rolling mill with a barrel length of the work rolls of 2450 mm, said strip S having a width of 1600 mm, corresponding to the width of the cast slab, and is rolled always with a double crown so as to be subsequently divided longitudinally into two half-strips of 800 mm.

The work rolls 24*a*, 24*b* shown in FIGS. 13B and 13C, in the example case have a shaped profile with a double negative crown with rectilinear end segments (not shaped) since the strip to be rolled now has a width smaller than the previous example.

FIGS. 13B, 13C represent the overall profile of the work rolls 24*a*, 24*b* in a reciprocally non-shifted condition, while FIGS. 14B and 14C represent the shifted condition of the two work rolls 24*a*, 24*b* with the useful work profile L(Tu), L(Bu) respectively of the upper 24*a* (FIG. 14B) and lower 24*b* (FIG. 14C) work rolls represented with a solid line. The work rolls 24*a*, 24*b* in the example case are shifted by 50 mm.

The resulting profile of the strip S (FIG. 14D) has the two humps or positive crowns in a substantially symmetrical position, so that, after the longitudinal separation of the two portions by means of the sections 26, each portion has the correct crown pre-established according to the qualitative requirements demanded.

As in the previous cases, using the axial shifting allows to achieve control of the crown, as shown for example in FIG. 15.

As mentioned, the operation of imparting to the strip a double (or triple, or quadruple, . . . ) crown is performed in the last stands of the finishing mill 15, for example in the last one or in the last two or three, in the case of particularly thin thicknesses.

Figure 16:
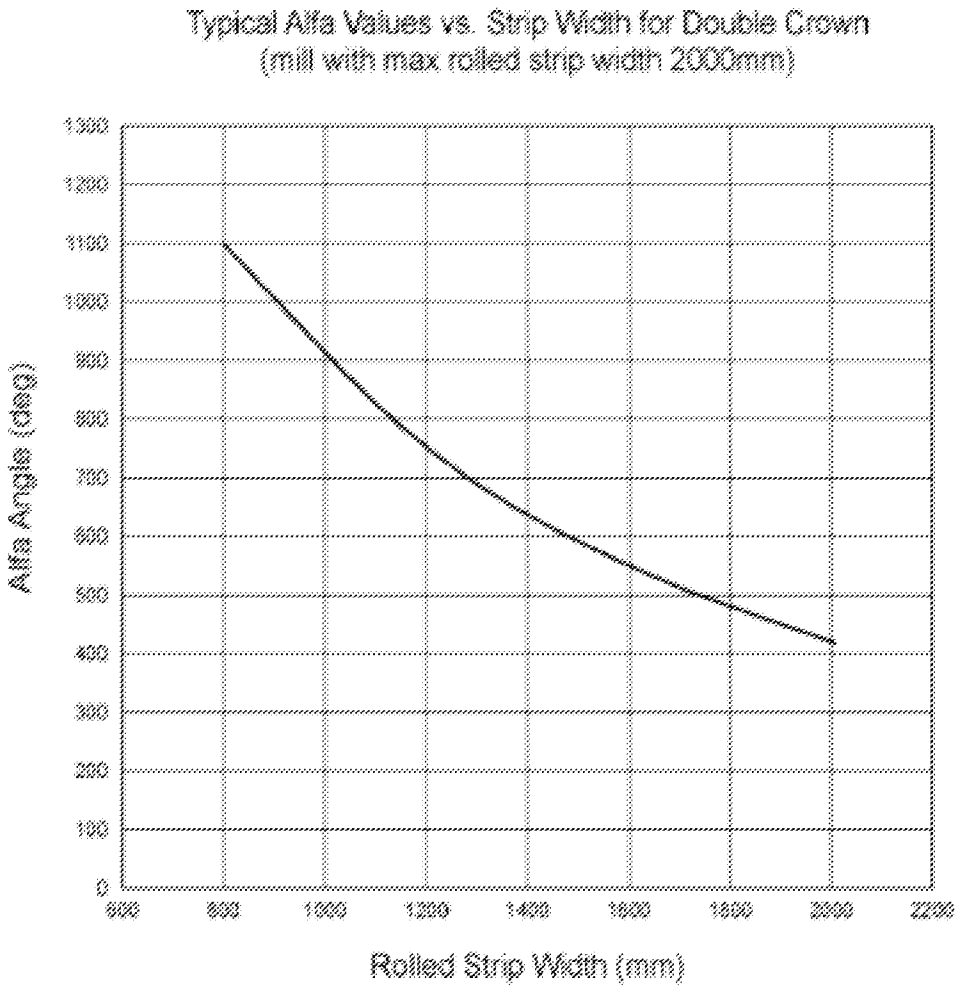
FIG. 16 shows a graph of the trend of the angle $\alpha$ as a function of the width of the strip being worked in the case of a double crown.

FIG. 16 shows how the amplitude of the angle $\alpha$ can vary as a function of the overall width of the rolled strip S, for example for width values comprised between 800 and 2000 mm in the case of a strip S having a double crown.

As mentioned above, multiple crown rolling requires strict control of the cooling efficiency on the width of the work roll, so that it can be selectively varied from the center to the periphery.

Figure 17:
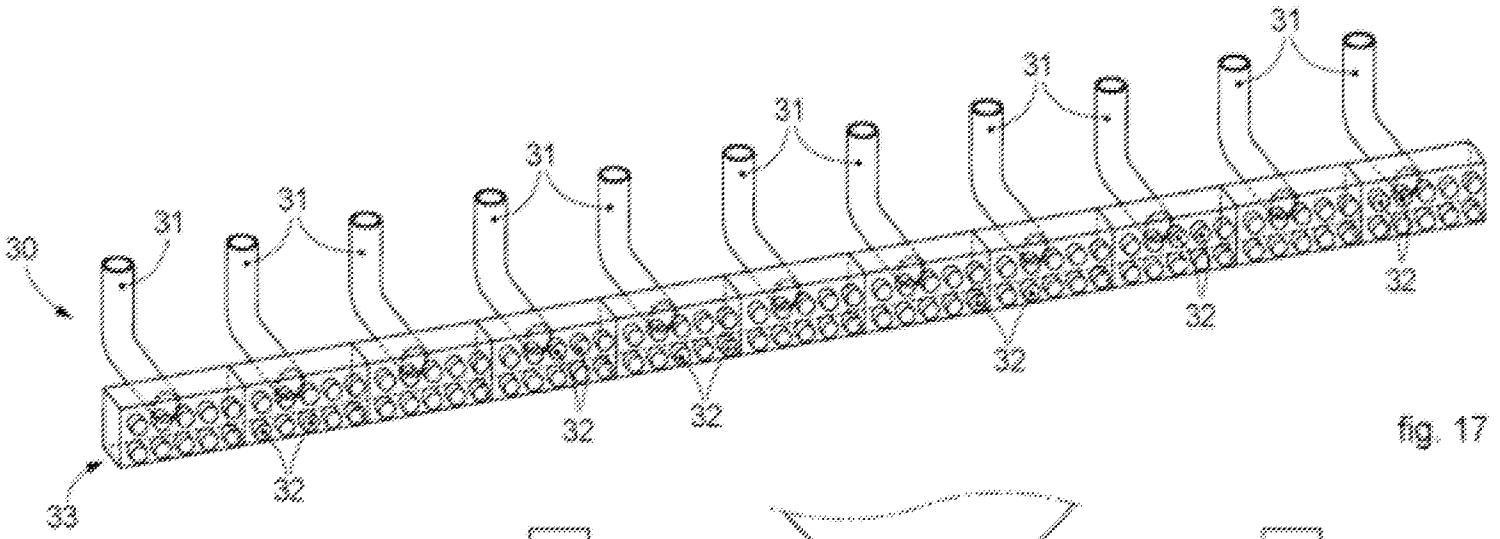
FIG. 17 shows an embodiment of a differentiated cooling system of the work rolls used in the production method according to the present invention.

According to the invention, as shown by way of example only in FIG. 17, a cooling system 30 is provided comprising one or more ramps 33 for delivering a cooling fluid with respective main feed pipes 31 and delivery nozzles 32 distributed over the entire width of the work rolls 24*a*, 24*b*.

The delivery nozzles 32 are disposed adjacent to each other with a determinate pitch in a double or triple row and are connected, in groups, to the pipes 31, independent from each other, so as to define independent and differentiated cooling zones on the width of the rolls. In the example shown in FIG. 17, the ramp is divided into eleven independent cooling zones.

Each feed pipe 31 is equipped with its own proportional valve that regulates the flow rate to the respective group of nozzles 32.

In this way, it is possible to have a separate management of the groups of nozzles 32 and therefore to vary the cooling on the corresponding surface zones of the work roll 24*a*, 24*b*.

According to the invention, also on the basis of the portions in width to be obtained starting from a given width of strip, each delivery ramp 33 can be divided into a plurality of independent zones, for example between 7 and 17. It is therefore possible to define suitable variations of cooling efficiency, along the axis of the work roll 24*a*, 24*b*, in particular in order to separately control the cooling on the two halves of the strip, or on the three, four or more portions into which the strip S will be subsequently divided.

For example, in the case of double crown working, it is advantageous to have a minimum cooling efficiency around the central zone of the work roll 24*a*, 24*b* so that the thermal crown increases in this zone, and instead have maximum cooling efficiency in correspondence with the zone of the roll that operates in correspondence with the central part of the two halves of the strip, so that the thermal crown decreases in this zone. In this way, the thermal crown can be controlled so that it follows the trend of the mechanical crown.

For example, with a work roll 24*a*, 24*b*, for producing strips with a maximum width of 2000 mm, the width of each zone can vary from about 130 mm to about 220 mm.

Figure 18:
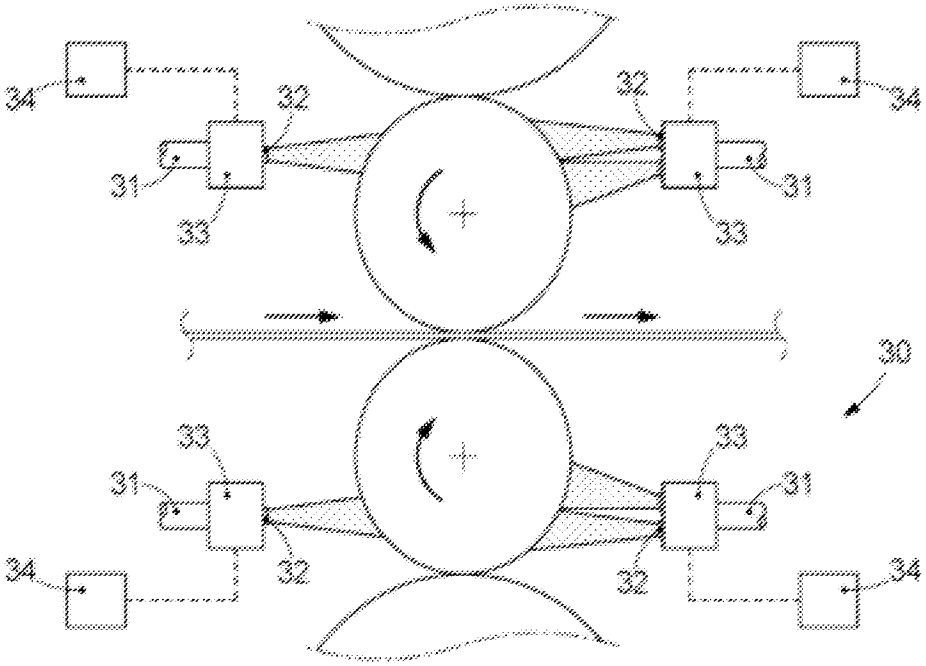
FIG. 18 schematically shows the positioning of the nozzles of the cooling system with respect to the work rolls.

According to some embodiments, for example described with reference to FIG. 18, the cooling system 30 can comprise four cooling ramps 33 for each of the multiple crown finishing stands 16*a*-16*e*, disposed in pairs at entry and at exit to the upper 24*a* and lower 24*b* work rolls.

The cooling ramps 33 can advantageously be provided with drive devices 34 configured to move them toward/away from the respective work roll 24*a*, 24*b*, or rotate them with respect thereto, in order to modify the angle of incidence of the cooling liquid on the work roll 24*a*, 24*b*.

According to some embodiments, the strip S can be cut longitudinally in the processes downstream of the rolling mill 12, and then be entirely wound into coils with multiple crown profile.

According to some variants, it can be provided that the strip S is wound for an initial head segment with a multiple crown profile, and subsequently a cutting disk located upstream of the reel 21 is driven in order to longitudinally divide the strip S while the winding continues. In this case, the longitudinal cutting can be interrupted before the final tail end, which therefore remains whole as the head, with a multiple crown profile.

It is clear that modifications and/or additions of parts may be made to the plant and to the method as described heretofore, without departing from the field and scope of the present invention.

The invention claimed is:

1. A method for producing flat rolled products, the method comprising:

carrying out a rolling step in a rolling mill comprising a plurality of finishing stands equipped with respective work rolls, in order to produce a strip of a determinate width with a multiple positive crown transverse profile, wherein during the rolling step, the work rolls are cooled with cooling intensity which is adjusted as a function of the multiple negative crown profile of the work rolls and cooling fluid is delivered by means of one or more ramps with respective main feed pipes and delivery nozzles distributed over the entire width of the work rolls, wherein each feed pipe is equipped with its own proportional valve which is configured to regulate the flow rate to a respective group of nozzles during the rolling step in order to have a separate management of the groups of nozzles, and wherein during the rolling step, a thermal crown of the work roll is controlled so that the thermal crown of the work roll follows the trend of the multiple negative crown profile of the work rolls such that less cooling occurs where the strip will be divided and more cooling occurs in the central zones of the respective multi-strips, and dividing the strip of a determinate width in longitudinal direction in a number of portions corresponding to the number of positive crowns in the transverse profile, wherein at least the work rolls of the last finishing stand are provided to have a profile with multiple negative crowns, wherein the number of crowns present in the profile of the work rolls is correlated to the number of portions into which the strip produced is subsequently divided in the longitudinal direction.

2. The method as in claim 1, wherein the work rolls are provided to have an axial shifting movement, and wherein said axial shifting movement allows to modify the position of the crowns of the work rolls with respect to the position of the strip.

3. The method as in claim 1, wherein the rolling mill comprises three finishing stands having work rolls with the same diameter and same profile, and wherein the profile of the work rolls with multiple negative mechanical crown is applied in said three finishing stands.

4. The method as in claim 3, wherein said three stands are the last three finishing stands of the plurality of finishing stands.

5. The method as in claim 1, wherein equations of a curve of the shaped profile of the work rolls are as follows:

$$D_t(y)=D-C\sin\alpha/b(y-\delta_s-\delta_0)+a_1(y-\delta_s-\delta_0)+a_3(y-\delta_s-\delta_0)^3$$

$$D_b(y)D+C\sin\alpha/b(y+\delta_s+\delta_0)+a_1(y+\delta_s+\delta_0)+a_3(y+\delta_s+\delta_0)^3$$

wherein

Dt(y) is the diameter of the upper work roll;

Db(y) is the diameter of the lower work roll;

D is the nominal diameter of the work roll;

$\alpha$ is the angle of the modifiable shape of a curve of a gap between the work rolls;

b is the barrel length of the work roll;

C is the amplitude of sine curve;

$\delta 0$ is the value of a primary displacement of the shaped curve of the work roll;

$\delta s$ is the value of the relative movement from a primary position;

$a_1$ is a first coefficient;

$a_3$ is a second coefficient;

and wherein by acting on the parameters $\alpha$ and C the multiple positive transverse crown profile is determined in relation to the number of portions of strip into which the strip has to be divided.

6. The method as in claim 1, wherein the multiple positive crown transverse profile is a double crown positive transverse profile.

7. A plant for producing flat rolled products, the plant comprising: a rolling mill comprising a plurality of finishing stands equipped with respective work rolls, wherein, in order to obtain strips with a multiple positive crown transverse profile which, in a subsequent step and in a moment that follows the end of the rolling, will be longitudinally sectioned into multiple portions, at least the last finishing stand of the plurality of finishing stands comprises work rolls having a multiple negative crown profile, wherein the number of crowns present in the profile of the work rolls is correlated to the number of portions into which the strip will be divided, wherein said plant comprises a differentiated cooling system for cooling the work rolls with cooling intensity able to be adjusted as a function of the multiple negative crown shaped profile of the work rolls, wherein said cooling system comprises one or more ramps for delivering a cooling fluid with respective main feed pipes and delivery nozzles distributed over the entire width of the work rolls, wherein each feed pipe is equipped with its own proportional valve which is configured to regulate the flow rate to a respective group of nozzles in order to have a separate management of the groups of nozzles and therefore to vary the cooling on the corresponding surface zones of the work roll and control a thermal crown of the work roll so that it follows the trend of the multiple negative crown profile of the work rolls.

8. The plant as in claim 7, wherein at least the last three stands of the plurality of finishing stands have work rolls having a multiple negative crown profile.

9. The plant as in claim 7, wherein the work rolls are equipped with an axial shifting movement, wherein magnitude and direction of the axial shifting movement is correlated to obtaining a desired profile to be obtained on the strip(S).

10. The plant as in claim 7, configured to operate in either one and/or the other of endless, semi-endless or coil-to-coil modes.

11. The plant as in claim 7, wherein said delivery nozzles are disposed adjacent to each other, with a determinate pitch, in double or triple rows and connected in groups to respective feed pipes, independent from each other, so as to define independent and differentiated cooling zones on the width of the rolls.

12. A finishing stand for a rolling plant for strips, comprising: a work roll with a multiple negative crown profile, wherein the number of crowns present in the profile of said work roll is correlated to a number of portions into which the strip produced is intended to be divided longitudinally and a differentiated cooling system for cooling the work rolls with cooling intensity able to be adjusted as a function of the multiple negative crown shaped profile of the work rolls, wherein said cooling system comprises one or more ramps for delivering a cooling fluid with respective main feed pipes and delivery nozzles distributed over the entire width of the work rolls, wherein each feed pipe is equipped with its own proportional valve which is configured to regulate the flow rate to a respective group of nozzles in order to have a separate management of the groups of nozzles and therefore to vary the cooling on the corresponding surface zones of the work roll and control a thermal crown of the work roll so that it follows the trend of the multiple negative crown profile of the work rolls.

* * * * *